US009651912B2

(12) United States Patent
Onishi

(10) Patent No.: US 9,651,912 B2
(45) Date of Patent: May 16, 2017

(54) IMAGE FORMING APPARATUS

(71) Applicant: KYOCERA Document Solutions Inc., Osaka (JP)

(72) Inventor: Kenichi Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/904,908

(22) PCT Filed: May 14, 2015

(86) PCT No.: PCT/JP2015/063914
§ 371 (c)(1),
(2) Date: Jan. 13, 2016

(87) PCT Pub. No.: WO2015/178283
PCT Pub. Date: Nov. 26, 2015

(65) Prior Publication Data

US 2016/0147190 A1 May 26, 2016

(30) Foreign Application Priority Data

May 22, 2014 (JP) ..... 2014-106344

(51) Int. Cl.
*G03G 15/00* (2006.01)
*G03G 21/14* (2006.01)

(52) U.S. Cl.
CPC ..... *G03G 15/6561* (2013.01); *G03G 15/6564* (2013.01); *G03G 21/14* (2013.01); *G03G 2215/00945* (2013.01)

(58) Field of Classification Search
CPC ..... G03G 15/6564
(Continued)

(56) References Cited

U.S. PATENT DOCUMENTS 4,610,739 A * 9/1986 Jensen ..... B32B 38/1841 156/324
5,482,265 A * 1/1996 Nakazato ..... G03G 15/6529 271/242

(Continued)

FOREIGN PATENT DOCUMENTS

JP 2001-206583 A 7/2001
JP 2002-326741 A 11/2002
JP 2005-060107 A 3/2005

OTHER PUBLICATIONS

International Search Report; issued in PCT/JP2015/063914; mailed Jul. 7, 2015.

*Primary Examiner* — Anthony Nguyen
(74) *Attorney, Agent, or Firm* — Studebaker & Brackett PC

(57) ABSTRACT

An image forming apparatus (100) includes a sheet feed section (120), an image forming section (180), a sheet feed roller (21), a pair of registration rollers (41), a pair of intermediate rollers (31), a first detection section (S1), a control section (10), and a storage section (50). The control section (10) calculates a sheet interval (T1) between a preceding sheet (Pa) and a succeeding sheet (Pb) based on a detection result of the first detection section (S1). The control section (10) determines based on the sheet interval (T1) and an ideal sheet interval (Ta), a second-linear-velocity period (T2) in which either or both a linear velocity (Vs) of the sheet feed roller (21) and a linear velocity (Vm) of the pair of intermediate rollers (31) are adjusted to a second linear velocity (V2).

5 Claims, 2 Drawing Sheets

(58) Field of Classification Search
USPC ..... 399/396
See application file for complete search history.

(56) References Cited

U.S. PATENT DOCUMENTS

| | | | | |
|---|---|---|---|---|
| 2002/0176725 | A1* | 11/2002 | Sato | B41J 11/0095 399/388 |
| 2006/0251452 | A1* | 11/2006 | Isozaki | G03G 15/6567 399/388 |
| 2007/0041762 | A1* | 2/2007 | Ishida | G03G 15/6564 399/388 |
| 2008/0258380 | A1* | 10/2008 | Okumura | B65H 5/062 271/258.01 |
| 2008/0292334 | A1* | 11/2008 | Takahashi | B41J 11/0095 399/38 |
| 2011/0037990 | A1* | 2/2011 | Unno | G03G 15/50 358/1.5 |
| 2013/0043647 | A1* | 2/2013 | Fujii | G03G 15/6564 271/226 |
| 2014/0056630 | A1* | 2/2014 | Kanno | G03G 15/6529 399/396 |

* cited by examiner

IMAGE FORMING APPARATUS

TECHNICAL FIELD

The present disclosure relates to image forming apparatuses.

BACKGROUND ART

In a typical image forming apparatus, a sheet is fed from a sheet feed section by a sheet feed roller and conveyed to a registration roller by a plurality of conveyance rollers. In feeding a sheet, the sheet feed roller may skids on the surface of the sheet to cause delay in sheet conveyance.

In order to reduce variation in sheet feeding timing, an image forming apparatus disclosed in Patent Literature 1 determines a conveyance speed based on timing at which a sensor detects a sheet.

CITATION LIST

Patent Literature

[Patent Literature 1]

Japanese Patent Application Laid-Open Publication No. 2001-206583

SUMMARY OF INVENTION

Technical Problem

However, the conveyance speed may vary according to timing at which a sheet is detected in the image forming apparatus disclosed in Patent Literature 1. This may result in unstable conveyance control. In addition, sheet conveyance at excessively high conveyance speed may generate noise.

The present invention has been made in view of the foregoing and has an object of providing an image forming apparatus capable of performing control for stable conveyance.

Solution to Problem

An image forming apparatus according to the present invention conveys a plurality of sheets along a conveyance path in a conveyance direction. The image forming apparatus forms image on the sheets. The image forming apparatus includes a sheet feed section, an image forming section, a sheet feed roller, a pair of registration rollers, a pair of intermediate rollers, a first detection section, a control section, and a storage section. The sheet feed section is to be loaded with sheets. The image forming section forms an image on a sheet. The sheet feed roller feeds a sheet from the sheet feed section. The pair of registration rollers is disposed downstream of the sheet feed roller in terms of the conveyance direction. The pair of registration rollers performs skew correction on the sheet. The pair of intermediate roller is disposed between the sheet feed roller and the pair of registration rollers. The first detection section detects presence or absence of the sheet at a first detection point located downstream of the sheet feed roller and upstream of the pair of intermediate rollers in terms of the conveyance direction. The control section adjusts a linear velocity of the sheet feed roller and a linear velocity of the pair of intermediate rollers to a first linear velocity or a second linear velocity greater than the first linear velocity. The storage section stores therein an ideal sheet interval that indicates an ideal value of an interval between a preceding sheet and a succeeding sheet that are conveyed successively. The control section calculates a sheet interval between the preceding sheet and the succeeding sheet based on the detection result of the first detection section. The control section determines based on the sheet interval and the ideal sheet interval, a second-linear-velocity period in which either or both of the linear velocity of the sheet feed roller and the linear velocity of the pair of intermediate rollers are adjusted to the second linear velocity.

Advantageous Effects of Invention

The image forming apparatus according to the present invention can perform control for stable conveyance.

DESCRIPTION OF EMBODIMENTS

Figure 1:
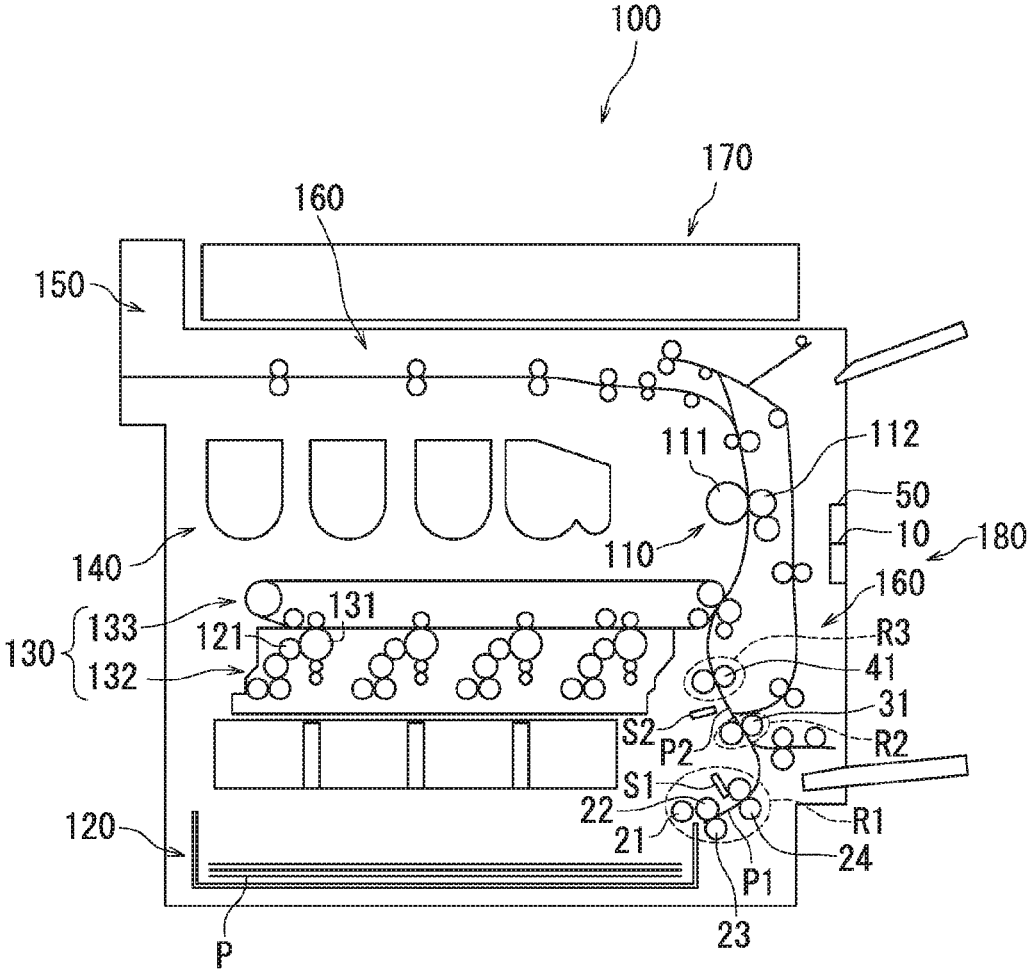
FIG. 1 is a schematic diagram illustrating an image forming apparatus according to an embodiment of the present invention.

The following describes an embodiment of the present invention with reference to the accompanying drawings. Like reference signs denote like elements or corresponding elements in the drawings, and description thereof is not repeated.

With reference to FIG. 1, a description will be given about an image forming apparatus 100 according to an embodiment of the present invention. FIG. 1 is a schematic diagram illustrating the image forming apparatus 100 according to the embodiment of the present invention.

The image forming apparatus 100 may be a copier, printer, facsimile machine, or multifunction peripheral having functions of the aforementioned machines. A copier will be described below as an example. However, the present invention is not limited to the copier. The image forming apparatus 100 includes an image reading section 170, an image forming section 180, a control section 10, a storage section 50, a sheet feed section 120, a sheet feed roller 21, a feed roller 22, a retard roller 23, a pair of conveyance rollers 24, a pair of intermediate rollers 31, a pair of registration rollers 41, a sheet sensor S1 (an example of a first detection section), and a registration sensor S2 (an example of a second detection section). The image forming section 180 includes a fixing device 110, an imaging section 130, a toner replenishment device 140, a sheet ejecting section 150, and a sheet conveyance section 160. The image forming section 180 forms an image on a sheet P based on image data generated by the image reading section 170.

The sheet feed section 120 is loaded with sheets P for printing. In printing, a sheet P loaded in the sheet feed section 120 is conveyed to the image forming section 180 via the sheet feed roller 21, the feed roller 22, the retard roller 23, the pair of conveyance rollers 24, the pair of intermediate rollers 31, and the pair of registration rollers 41.

The sheet feed roller 21 feeds the sheet P from the sheet feed section 120. The sheet P fed by the sheet feed roller 21 is conveyed to the feed roller 22 and the retard roller 23. The feed roller 22 is located opposite to and in pressed contact with the retard roller 23. The feed roller 22 rotates to feed the sheet P in a conveyance direction. When a single sheet P is fed, the retard roller 23 follows the rotation of the feed roller 22 to be rotated. By contrast, when a plurality of sheets P are fed in a layered manner, the retard roller 23 rotates in a direction opposite to a direction in which the sheets P are fed or stops to separate a sheet P in contact with the feed roller 22 from the other sheet P. Thus, the single sheet P is fed by the feed roller 22.

The pair of conveyance rollers 24 and the pair of intermediate rollers 31 are disposed between the sheet feed roller 21 and the pair of registration rollers 41 and feed the sheet P fed by the feed roller 22 and the retard roller 23, toward the pair of registration rollers 41 while sandwiching the sheet P therebetween. The pair of registration rollers 41 performs skew correction on the sheet P that comes to stop upon contact with the pair of registration rollers 41. The pair of registration rollers 41 temporarily holds the sheet P stationary in order to synchronize transfer timing with conveyance of the sheet P and then feeds the sheet P to the image forming section 180 in accordance with the transfer timing.

The sheet P conveyed to the image forming section 180 is conveyed in the conveyance direction along a conveyance path through the imaging section 130 and the fixing device 110 by the sheet conveyance section 160 and ejected from the sheet ejecting section 150.

The imaging section 130 forms a toner image on the sheet P. The imaging section 130 includes a photoreceptor 131, a developing device 132, and a transfer device 133.

An electrostatic latent image is formed on the photoreceptor 131 using for example a laser. The laser is emitted based on electronic signals representing an original document image generated in the image reading section 170. The developing device 132 includes a development roller 121. The development roller 121 supplies toner to the photoreceptor 131 to develop the electrostatic latent image, thereby forming a toner image on the photoreceptor 131. The toner replenishment device 140 replenishes the developing device 132 with toner.

The transfer device 133 transfers the toner image formed on the photoreceptor 131 to the sheet P.

The fixing device 110 applies heat and pressure to the sheet P using a fixing member 111 and a pressure member 112 to melt the toner image that has been formed by the imaging section 130 and is not fixed yet, thereby fixing the toner image to the sheet P.

The control section 10 controls the rotational speeds of the sheet feed roller 21 and the pair of intermediate rollers 31 to change the conveyance speed of the sheet P by the sheet feed roller 21 and the pair of intermediate rollers 31. That is, the control section 10 adjusts the linear velocity of the sheet feed roller 21 and the linear velocity of the pair of intermediate rollers 31. The image forming apparatus 100 includes a roller group R1, a roller group R2, and a roller group R3. The sheet feed roller 21, the feed roller 22, the retard roller 23, and the pair of conveyance rollers 24 belong to the roller group R1. The pair of intermediate rollers 31 belongs to the roller group R2. The pair of registration rollers 41 belongs to the roller group R3. The control section 10 is capable of adjusting the linear velocities on a roller group-by-roller group basis. The sheet feed roller 21, the feed roller 22, and the retard roller 23, which belong to the same roller group, rotate at the same linear velocity.

The storage section 50 stores therein an ideal sheet interval that indicates an ideal value of an interval between a preceding sheet Pa and a succeeding sheet Pb that are successively conveyed.

The sheet sensor S1 and the registration sensor S2 detect the presence or absence of a sheet P at respective detection points. The sheet sensor S1 is disposed downstream of the sheet feed roller 21 and upstream of the pair of conveyance rollers 24 in terms of the conveyance direction of the sheet P (between the sheet feed roller 21 and the pair of conveyance rollers 24). The sheet sensor S1 detects the presence or absence of the sheet P at a first detection point P1. The registration sensor S2 is disposed upstream of the pair of registration rollers 41 and downstream of the pair of intermediate rollers 31 in terms of the conveyance direction of the sheet P (between the pair of intermediate rollers 31 and the pair of registration rollers 41). The registration sensor S2 detects the presence or absence of the sheet P at a second detection point P2.

Figure 2A:
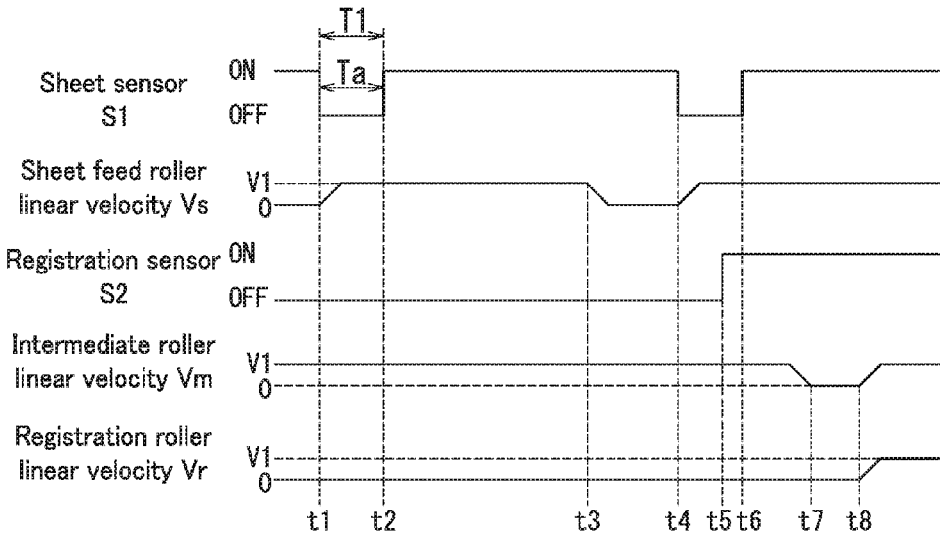
FIG. 2A is a time chart depicting detection signals of sensors and linear velocities of rollers in the image forming apparatus according to the embodiment of the present invention.
Figure 2B:
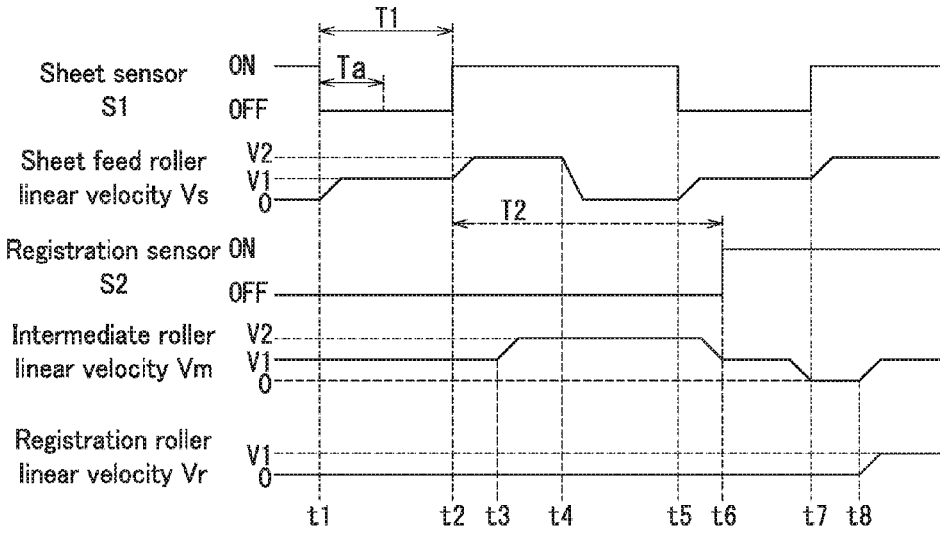
FIG. 2B is a time chart depicting detection signals of the sensors and linear velocities of the rollers in the image forming apparatus according to the embodiment of the present invention.

With reference to FIGS. 1, 2A, and 2B, a description will be given next about operation of the image forming apparatus 100 according to the embodiment of the present invention. FIGS. 2A and 2B are time charts depicting detection signals of the sensors and linear velocities of respective rollers in the image forming apparatus 100 according to the embodiment of the present invention.

With reference to FIG. 2A, a description will be made first about an operation of the image forming apparatus 100 in a situation in which a sheet interval T1 is not greater than the ideal sheet interval Ta.

Upon the trailing edge of a preceding sheet Pa passing over the first detection point P1 at a time point t1, a signal output from the sheet sensor S1 changes from high (on) to low (off). In response to the output signal from the sheet sensor S1 changing from high to low, the control section 10 changes a sheet feed roller linear velocity Vs from zero to a first linear velocity V1. As a result, the sheet feed roller 21 feeds a succeeding sheet Pb from the sheet feed section 120.

Upon the leading edge of the succeeding sheet Pb passing over the first detection point P1 at a time point t2, the signal output from the sheet sensor S1 changes from low (off) to high (on). The control section 10 calculates based on a detection result of the sheet sensor S1, a sheet interval T1 between the preceding sheet Pa and the succeeding sheet Pb that are successively conveyed. For example, the control section 10 calculates a difference (t2−t1) between the time t1 and the time t2 as the sheet interval T1. The sheet interval T1 herein is not greater than the ideal sheet interval Ta. Accordingly, the succeeding sheet Pb is conveyed without any delay relative to ideal time.

At a time point t3, the control section 10 changes the sheet feed roller linear velocity Vs from the first linear velocity V1 to zero.

Upon the trailing edge of the succeeding sheet Pb passing over the first detection point P1 at a time point t4, the signal output from the sheet sensor S1 changes from high to low. The control section 10 accordingly changes the sheet feed roller linear velocity Vs from zero to the first linear velocity V1. As a result, the sheet feed roller 21 feeds from the sheet feed section 120, a sheet Pc that is to be conveyed after the succeeding sheet Pb.

Upon the leading edge of the succeeding sheet Pb passing over the second detection point P2 at a time point t5, a signal output from the registration sensor S2 changes from low (off) to high (on).

Upon the leading edge of the sheet Pc conveyed after the succeeding sheet Pb passing over the first detection point P1 at a time point t6, the signal output from the sheet sensor S1 changes from low (off) to high (on).

The control section 10 changes an intermediate roller linear velocity Vm from the first linear velocity V1 to zero at a time point t7. The pair of registration rollers 41 performs skew correction on the succeeding sheet Pb until the time point t7.

At a time point t8, the control section 10 changes the intermediate roller linear velocity Vm and the registration roller linear velocity Vr from zero to the first linear velocity V1. As a result, the succeeding sheet Pb is conveyed to the image forming section 180.

As described with reference to FIG. 2A, in a situation in which the sheet interval T1 is not greater than the ideal sheet interval Ta, the control section 10 determines not to provide a second-linear-velocity period T2 in which either or both the sheet feed roller linear velocity Vs and the intermediate roller linear velocity Vm are adjusted to a second linear velocity. Therefore, neither the sheet feed roller linear velocity Vs nor the intermediate roller linear velocity Vm is adjusted to the second linear velocity V2.

With reference to FIG. 2B, a description will be made next about an operation of the image forming apparatus 100 in a situation in which a sheet interval T1 is greater than the ideal sheet interval Ta.

Upon the trailing edge of a preceding sheet Pa passing over the first detection point P1 at a time point t1, the signal output from the sheet sensor S1 changes from high (on) to low (off). In response to the signal output from the sheet sensor S1 changing from high to low, the control section 10 changes the sheet feed roller linear velocity Vs from zero to the first linear velocity V1. As a result, the sheet feed roller 21 feeds a succeeding sheet Pb from the sheet feed section 120.

Upon the leading edge of the succeeding sheet Pb passing over the first detection point P1 at a time point t2, the signal output from the sheet sensor S1 changes from low (off) to high (on). The control section 10 calculates based on a detection result of the sheet sensor S1, a sheet interval T1 between the preceding sheet Pa and the succeeding sheet Pb that are successively conveyed. For example, the control section 10 calculates a difference (t2−t1) between the time t1 and the time t2 as the sheet interval T1. The sheet interval T1 herein is greater than the ideal sheet interval Ta. This means that the succeeding sheet Pb is being conveyed behind ideal time.

The control section 10 then determines the second-linear-velocity period T2 in which either or both the sheet feed roller linear velocity Vs and the intermediate roller linear velocity Vm are adjusted to a second linear velocity V2. The second-linear-velocity period may be obtained by Equation 1 below, for example.

$$T2=(V1\times T1-L)/(V2-V1) \quad \text{(Equation 1)}$$

Wherein, T2 represents the second-linear-velocity period; V1 represents the first linear velocity; V2 represents the second linear velocity, and L represents a distance between sheets set for achieving satisfactory productivity. The distance L is preset according to sheet size. The second linear velocity V2 is determined taking account of noise. The second-linear-velocity period T2 herein is a period from the time point t2 to a time point t6. In one example, the first linear velocity V1 may be 200 mm/sec. The second linear velocity V2 may be 400 mm/sec. The distance L may be 40 mm. The sheet interval T1 may be 300 ms. The second-linear-velocity period T2 may be 100 ms.

The control section 10 changes the sheet feed roller linear velocity Vs from the first linear velocity V1 to the second linear velocity V2 at the time point t2.

At a time point t3 before the succeeding sheet Pb arrives at the pair of intermediate rollers 31, the control section 10 changes the intermediate roller linear velocity Vm from the first linear velocity V1 to the second linear velocity V2.

At a time point t4 after the trailing edge of the succeeding sheet Pb passes over the sheet feed roller 21, the control section 10 changes the sheet feed roller linear velocity Vs from the second linear velocity V2 to zero.

Upon the trailing edge of the succeeding sheet Pb passing over the first detection point P1 at a time point t5, the signal output from the sheet sensor S1 changes from high (on) to low (off). The control section 10 accordingly changes the sheet feed roller linear velocity Vs from zero to the first linear velocity V1. As a result, the sheet feed roller 21 feeds from the sheet feed section 120, a sheet Pc to be conveyed after the succeeding sheet Pb.

Upon the leading edge of the succeeding sheet Pb passing over the second detection point P2 at the time point t6, the signal output from the registration sensor S2 changes from low (off) to high (on). Before the signal output from the registration sensor S2 changes to high, that is, before the registration sensor S2 detects arrival of the sheet Pb, the control section 10 changes the intermediate roller linear velocity Vm from the second linear velocity V2 to the first linear velocity V1. In this manner, the intermediate roller linear velocity Vm is preferably at the first linear velocity V1 before being changed from the second linear velocity V2 to zero.

At a time point t7, the control section 10 changes the intermediate roller linear velocity Vm from the first linear velocity V1 to zero. Until the time point t7, the pair of registration rollers 41 performs skew correction on the succeeding sheet Pb. Further, upon the leading edge of the sheet Pc, which is being conveyed after the succeeding sheet Pb, passing over the first detection point P1, the signal output from the sheet sensor S1 changes from low (off) to high (on).

At a time point t8, the control section 10 changes each of the intermediate roller linear velocity Vm and the registration roller linear velocity Vr from zero to the first linear velocity V1. As a result, the pair of registration rollers 41 conveys the succeeding sheet Pb to the image forming section 180.

As described with reference to FIG. 2B, when the sheet interval T1 is greater than the ideal sheet interval Ta, the control section 10 determines to provide the second-linear-velocity period T2 in which either or both the sheet feed roller linear velocity Vs and the intermediate roller linear velocity Vm are adjusted to the second linear velocity. In the above configuration, either or both the sheet feed roller linear velocity Vs and the intermediate roller linear velocity Vm are at the second linear velocity V2 in the second-linear-velocity period T2.

As has been described so far with reference to FIGS. 1, 2A, and 2B, the control section 10 calculates the sheet interval T1 between the preceding sheet Pa and the succeeding sheet Pb based on the detection result of the first detection section (sheet sensor) S1. Based on the sheet interval T1 and the ideal sheet interval Ta, the control section 10 then determines the second-linear-velocity period T2 in which either or both the sheet feed roller linear velocity Vs of the sheet feed roller 21 and the intermediate roller linear velocity Vm of the pair of intermediate rollers 31 are adjusted to the second linear velocity V2. In the above configuration, even in a situation in which there is a delay in sheet feeding, the second-linear-velocity period T2 allows the control section 10 to control conveyance of the sheets P at two linear velocities. This can keep constant sheet intervals.

An embodiment of the present invention has been described so far with reference to the drawings (FIGS. 1, 2A, and 2B). However, the present invention is not limited to the above-described embodiment and can be practiced in various ways within the scope without departing from the essence of the present invention. The drawings are schematic illustrations that emphasize elements of configuration in order to facilitate understanding thereof. Therefore, thickness, length, the number, etc. of each of the elements in the drawings may differ from reality for the sake of illustration convenience. The properties of each of the elements, such as material, shape, and dimension thereof described in the above embodiment are mere examples and not specific limitations. A wide range of variations of the properties can be made to the embodiment so long as such variations do not deviate from the intended scope of the present disclosure.

INDUSTRIAL APPLICABILITY

The present invention is applicable to a field of image forming apparatuses.

The invention claimed is:

1. An image forming apparatus that conveys a plurality of sheets along a conveyance path in a conveyance direction and forms images on the sheets, the image forming apparatus comprising:

a sheet feed section to be loaded with sheets;

an image forming section configured to form an image on a sheet;

a sheet feed roller configured to feed a sheet from the sheet feed section;

a pair of registration rollers disposed downstream of the sheet feed roller in terms of the conveyance direction and configured to perform skew correction on the sheet;

a pair of intermediate rollers disposed between the sheet feed roller and the pair of registration rollers;

a first detection section configured to detect presence or absence of a sheet at a first detection point located downstream of the sheet feed roller and upstream of the pair of intermediate rollers in terms of the conveyance direction;

a control section configured to adjust a linear velocity of the sheet feed roller and a linear velocity of the pair of intermediate rollers to a first linear velocity or a second linear velocity greater than the first linear velocity; and a storage section configured to store therein an ideal sheet interval that indicates an ideal value of an interval between a preceding sheet and a succeeding sheet that are conveyed successively, wherein the control section calculates a sheet interval between the preceding sheet and the succeeding sheet based on a detection result of the first detection section and the control section determines based on the sheet interval and the ideal sheet interval, a second-linear-velocity period in which either or both of the linear velocity of the sheet feed roller and the linear velocity of the pair of intermediate rollers are adjusted to the second linear velocity, the image forming apparatus further comprises a second detection section configured to detect presence or absence of a sheet at a second detection point located upstream of the pair of registration rollers and downstream of the pair of intermediate rollers in terms of the conveyance direction, and the second-linear-velocity period is included in a period from a time point when the first detection section detects arrival of a sheet to a time point when the second detection section detects arrival of the sheet.

2. The image forming apparatus according to claim 1, wherein the control section determines whether or not to provide the second-linear-velocity period according to whether or not the sheet interval is greater than the ideal sheet interval.

3. The image forming apparatus according to claim 2, wherein the control section determines to provide the second-linear-velocity period when the sheet interval is greater than the ideal sheet interval and determines not to provide the second-linear-velocity period when the sheet interval is not greater than the ideal sheet interval.

4. The image forming apparatus according to claim 1, wherein a signal output from the first detection section is switched between on and off according to the presence or absence of a sheet at the first detection point, and the sheet interval is represented by a period from a time point when the first detection section detects off to a time point when the first detection section detects on.

5. The image forming apparatus according to claim 1, wherein the control section changes the linear velocity of the pair of intermediate rollers from the second linear velocity to the first linear velocity before the second detection section detects arrival of the sheet.

* * * * *